US010415344B2

(12) United States Patent
Jacob et al.

(10) Patent No.: US 10,415,344 B2
(45) Date of Patent: Sep. 17, 2019

(54) TECHNIQUE AND APPARATUS FOR USING AN UNTETHERED OBJECT TO FORM A SEAL IN A WELL

(71) Applicant: Schlumberger Technology Corporation, Sugar Land, TX (US)

(72) Inventors: Gregoire Jacob, Houston, TX (US); Indranil Roy, Missouri City, TX (US); Michael Dardis, Richmond, TX (US); Isaac Aviles Cadena, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/014,859

(22) Filed: Feb. 3, 2016

(65) Prior Publication Data

US 2016/0251930 A1 Sep. 1, 2016

Related U.S. Application Data

(60) Provisional application No. 62/126,162, filed on Feb. 27, 2015.

(51) Int. Cl.
*E21B 33/12* (2006.01)
*E21B 33/134* (2006.01)

(52) U.S. Cl.
CPC ..... *E21B 33/134* (2013.01); *E21B 33/1208* (2013.01)

(58) Field of Classification Search
CPC .... E21B 33/128; E21B 33/13; E21B 33/1208; E21B 33/134
USPC ..... 166/280.1, 280.2, 281, 282, 283, 284
See application file for complete search history.

(56) References Cited

U.S. PATENT DOCUMENTS

| | | | | |
|---|---|---|---|---|
| 2,109,058 A | | 2/1938 | Blee | |
| 3,376,934 A | * | 4/1968 | Bertram | E21B 33/138 166/193 |
| 4,407,368 A | * | 10/1983 | Erbstoesser | C09K 8/516 166/193 |
| 4,505,334 A | * | 3/1985 | Doner | E21B 33/138 156/170 |
| 5,253,709 A | * | 10/1993 | Kendrick | E21B 33/138 166/193 |
| 6,655,475 B1 | | 12/2003 | Wald | |
| 7,775,279 B2 | | 8/2010 | Marya et al. | |
| 7,891,424 B2 | | 2/2011 | Creel et al. | |
| 8,025,102 B2 | | 9/2011 | Dewar | |

(Continued)

FOREIGN PATENT DOCUMENTS

| | | | |
|---|---|---|---|
| WO | WO 2015160341 A1 * | 10/2015 | E21B 33/134 |
| WO | WO-2015160341 A1 * | 10/2015 | E21B 33/134 |

*Primary Examiner* — James G Sayre

(57) ABSTRACT

An embodiment may take the form of a method usable with a well including communicating an untethered object downhole in the well to land the object in a restriction to form a fluid barrier, and using an agent carried by the untethered object to seal at least one gap in the fluid barrier. Another embodiment may take the form of an apparatus usable with a well having a solid component to be deployed and be communicated downhole as an untethered object to land in a restriction in the well to form a fluid barrier and an agent attached to the solid component to seal at least one gap in the fluid barrier.

18 Claims, 8 Drawing Sheets

(56) References Cited

U.S. PATENT DOCUMENTS

| | | | | |
|---|---|---|---|---|
| 8,211,247 | B2 | 7/2012 | Marya et al. | |
| 8,584,746 | B2 | 11/2013 | Marya et al. | |
| 8,950,438 | B2 | 2/2015 | Ryan | |
| 9,915,116 | B2 | 3/2018 | Jacob et al. | |
| 2007/0107908 | A1 | 5/2007 | Vaidya et al. | |
| 2011/0221137 | A1 | 9/2011 | Obi et al. | |
| 2012/0285695 | A1 | 11/2012 | Lafferty et al. | |
| 2014/0196899 | A1* | 7/2014 | Jordan | C22C 1/0416 166/284 |
| 2015/0129239 | A1* | 5/2015 | Richard | E21B 23/06 166/377 |
| 2015/0159462 | A1 | 6/2015 | Cutler | |
| 2015/0167424 | A1* | 6/2015 | Richards | E21B 33/134 166/386 |

* cited by examiner

TECHNIQUE AND APPARATUS FOR USING AN UNTETHERED OBJECT TO FORM A SEAL IN A WELL

This application claims the benefit of, U.S. Provisional Patent Application Ser. No. 62/126,162 filed on Feb. 27, 2015, incorporated by reference in its entirety.

BACKGROUND

For purposes of preparing a well for the production of oil or gas, various fluid barriers may be created downhole. For example, in a fracturing operation, a fluid barrier may be formed in the well inside a tubing string for purposes of diverting fracturing fluid into the surrounding formation. As other examples, a fluid barrier may be formed in the well for purposes of pressurizing a tubing string to fire a tubing conveyed pressure (TCP) perforating gun or for purposes of developing a pressure to shift open a string-conveyed valve assembly.

SUMMARY

The summary is provided to introduce a selection of concepts that are further described below in the detailed description. This summary is not intended to identify key or essential features of the claimed subject matter, nor is it intended to be used as an aid in limiting the scope of the claimed subject matter.

An embodiment may take the form of a method usable with a well including communicating an untethered object downhole in the well to land the object in a restriction to form a fluid barrier, and using an agent carried by the untethered object to seal at least one gap in the fluid barrier. Another embodiment may take the form of an apparatus usable with a well having a solid component to be deployed and be communicated downhole as an untethered object to land in a restriction in the well to form a fluid barrier and an agent attached to the solid component to seal at least one gap in the fluid barrier. Another embodiment may take the form of an apparatus usable with a well having a string comprising a passageway and having a restriction in the passageway and an untethered object to be deployed in the passageway. The untethered object includes a solid component to be deployed and be communicated downhole as an untethered object to land in a restriction in the well to form a fluid barrier and an agent attached to the solid component to seal at least one gap in the fluid barrier.

Advantages and other features will become apparent from the following drawing, description and claims.

DETAILED DESCRIPTION

Figure 1:
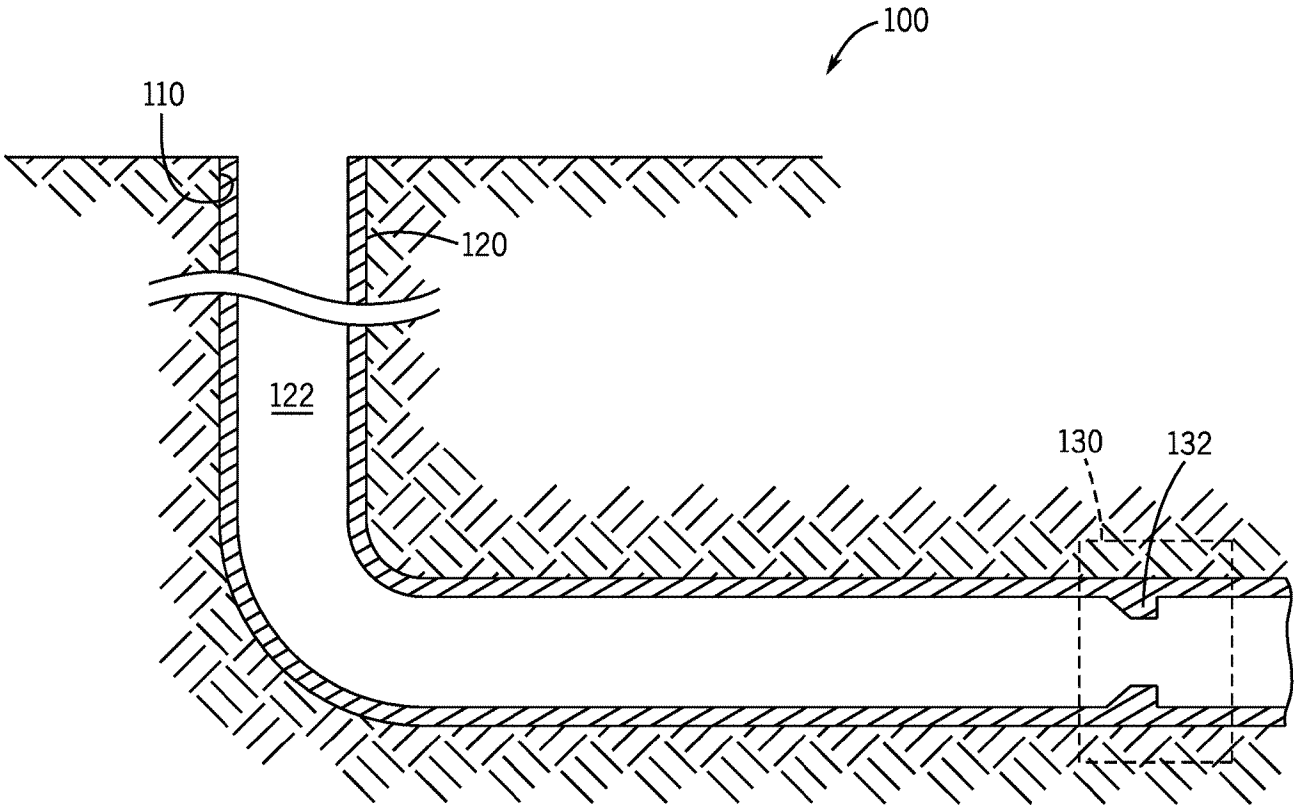
FIG. 1 is a schematic diagram of a well according to an example implementation.

In accordance with systems and techniques that are disclosed herein, an untethered object is used to carry, or deliver, a sealing agent to a specific location in a well. In this manner, in accordance with example implementations, an untethered object is deployed in a well for purposes of landing the object in a downhole restriction to form a fluid barrier and delivering a sealing agent (which is carried downhole by the object) to seal any openings (called "gaps" herein) in the fluid barrier. In this context, an "untethered object" refers to an object that travels at least some distance in a well passageway without being attached to a conveyance mechanism (a slickline, wireline, coiled tubing string, and so forth). As specific examples, the untethered object may have the general form of a dart, ball or bar. However, the untethered object may take on different forms, in accordance with further implementations. A "fluid barrier" refers to a fluid obstruction that may be formed at least in part by the untethered object landing in a downhole restriction.

As an example, the untethered object may be communicated downhole by pumping the untethered object (pushing the untethered object into the well with fluid that is delivered by a surface pump, for example) the untethered object through one or more tubular members, or strings, of the well, although pumping may not be employed to communicate the untethered object downhole in accordance with further implementations. The untethered object is constructed to land on a targeted downhole restriction, such as a seat assembly, for purposes of forming a fluid barrier. For example, the untethered object may be sphere, or ball-shaped; and the untethered object may have an outer diameter that corresponds to the size of a seat of the seat assembly.

A fluid seal may not be formed between the landed object and the seat assembly, even for the case in which the seat is a continuous ring. In this manner, one or multiple interstices, or gaps, may exist between the seated untethered object and the seat, due to intervening debris, surface irregularities in the object or seat, mismatched mating surfaces, and so forth. As disclosed herein, the untethered object carries an agent downhole, which has properties for sealing such gaps. In this context, "sealing" means filling the gap(s) to at close the gap(s). The resulting "seal" may or may not be a complete fluid seal, depending on the particular implementation and downhole environment.

In accordance with example implementations, the agent may be a deformable covering or outer layer of the untethered object, which deforms when the object lands in a downhole restriction for purposes of sealing gap(s) between the object and the restriction.

As other examples, the agent may contain a chemical that reacts in the presence of one or more well fluid(s) or a substance that swells in the presence of well fluid(s). As described herein in example implementations, after the untethered object lands in the downhole restriction, the agent disintegrates or diffuses in response to one or more flow paths that are created by the gap(s) in the fluid barrier, and the flow path(s) carry the agent into the gap(s) to seal the gap(s).

In general, the agent that is carried downhole by the untethered object may take on numerous forms. In this manner, the agent may be a liquid, powder, a solid, fibers, particles, a mixture of any of the foregoing components, and so forth.

As a more specific example, FIG. 1 schematically depicts a well 100 in accordance with example implementations. In general, the well 100 includes a wellbore 110, which traverses one or more formations (hydrocarbon bearing formations, for example). For the example of FIG. 1, the wellbore 110 may be lined, or supported, by a tubing string 120. The tubing string 120 may be cemented to the wellbore 110 (such as wellbores typically referred to as "cased hole" wellbores); or the tubing string 120 may be secured to the formation(s) by packers (such as the case for wellbores typically referred to as "open hole" wellbores).

It is noted that although FIG. 1 depicts a laterally extending wellbore, the systems and techniques that are disclosed herein may likewise be applied to vertical wellbores. In accordance with example implementations, the well 100 may contain multiple wellbores, which contain tubing strings that are similar to the illustrated tubing string 120. Moreover, depending on the particular implementation, the well 100 may be an injection well or a production well. Thus, many variations are contemplated, which are within the scope of the appended claims.

For the example implementation of FIG. 1, the tubing string 120 has a central passageway 122 and a corresponding lateral portion that contains a restriction 130. Moreover, for the example implementation of FIG. 1, the restriction 130 is formed by an object catching seat 132 of the tubing string 120. Depending on the particular implementation, the seat 132 may be a continuous seat ring or may be a segmented-type ring, which contains annular protrusions that are interleaved with openings. Moreover, the restriction 130 may take on numerous other forms, depending on the particular implementation.

Figure 2A:
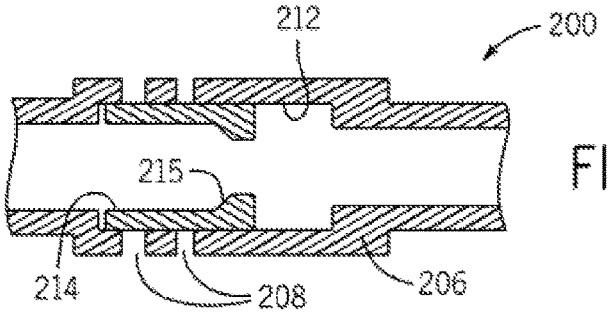
FIGS. 2A, 2B, 2C and 2D are cross-sectional views of downhole restrictions according to example implementations.

More specifically, in accordance with example implementations, the restriction 130 may be formed from a valve assembly 200 that is illustrated in FIG. 2A. In this regard, referring to FIG. 2A in conjunction with FIG. 1, the valve assembly 200 may include an outer tubular housing 206, which is constructed to be installed in line with the tubing string 120; and the outer housing 206 may contain radial flow ports 208 that, when the valve assembly 200 is open, establish fluid communication between a central passageway 201 of the valve assembly 200 and the region outside of the housing 206. As illustrated in FIG. 2A, the valve assembly 200 contains an inner sleeve 214 that operates within a defined annular inner space 212 of the housing 206 for purposes of opening and closing fluid communication through the radial flow ports 208.

As a more specific example, in accordance with some implementations, the valve assembly 200 may be a shifting-type valve assembly that is operated by, for example, lodging an object in a narrowed opening, or seat 215, of sleeve 214 for purposes of shifting the sleeve 214.

Figure 2B:
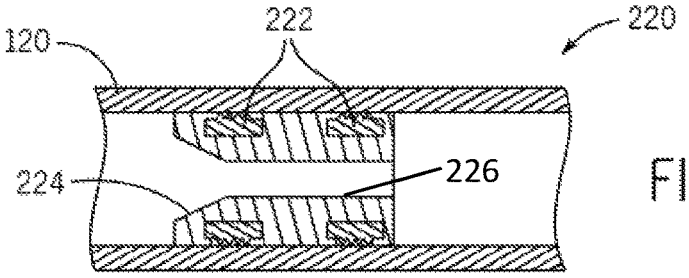

As another example, the restriction 130 may be formed from a plug or anchored seat assembly 220 that is depicted in FIG. 2B. Referring to FIG. 2B in conjunction with FIG. 1, the assembly 220 includes a seat portion 224 that is run downhole inside the passageway 122 (see FIG. 1) to a desired location and set. For example, the setting of the seat portion 224 inside the tubing string 120 may occur by setting corresponding slips 222 that secure the seat portion 224 to the inner wall of the tubing string 120. As illustrated in FIG. 2B, the seat portion 224 has a restricted inner passageway 226 to form a restriction.

Figure 2C:
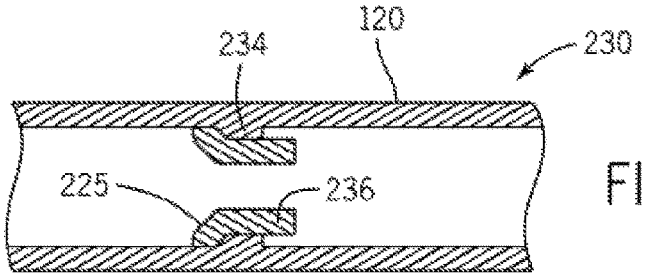

As another example of a restriction 130, FIG. 2C illustrates a seat assembly 230. Referring to FIG. 2C in conjunction with FIG. 1, for this example implementation, the tubing string 120 contains an inner shoulder 234 (i.e., a first restriction), which is constructed to receive a seat 236 that is run into the string 110. The seat 236 is constructed to land on the restriction 234 to form a second restriction 225.

Figure 2D:
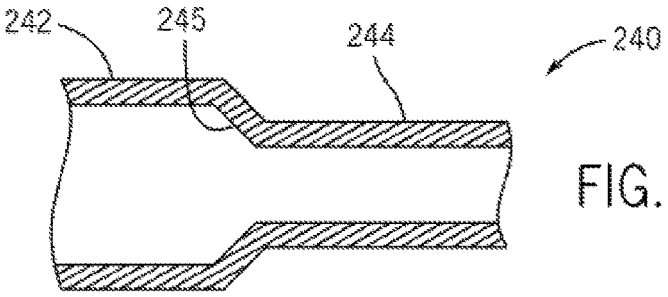

Referring to FIG. 2D in conjunction with FIG. 1, in accordance with further example implementations, a restriction 240 may be formed by a reduction in the string diameter. For this example, the restriction 240 includes a seat 245 that is formed from the reduction of diameters between a first string section 242 and a reduced diameter, second string section 244.

For example implementations that are discussed below, the restriction 130 is formed by the seat 132 of FIG. 1, although the restriction 130 may take on other forms, such as any of the restrictions of FIGS. 2A-2D, as well as other restrictions, in accordance with further implementations.

Figure 3:
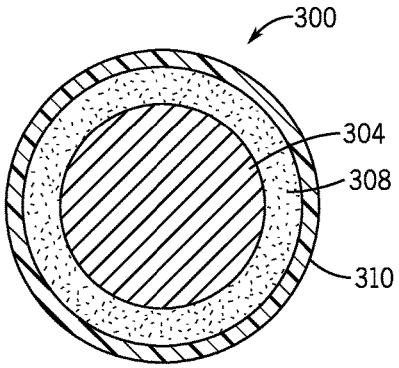
FIG. 3 is a cross-sectional view of an untethered object according to an example implementation.

Regardless of the form of the restriction 130, in accordance with example implementations, an untethered object may be pumped into the tubing string 120 for purposes of delivering a sealing agent to a targeted location downhole. Referring to FIG. 3, in accordance with example implementation, an untethered object 300 has the general shape of a sphere, or ball, and includes an inner, sphere-shaped solid component 304. In accordance with example implementations, the solid component 304 may be formed from a metal or metal alloy. In general, the solid component 304 provides a mass for the untethered object 300 and is generally sized to be caught by a downhole restriction.

Depending on the particular example implementation, the solid component 304 may be a ball (as shown in FIG. 3), a barrel or any shape, which can be received in a corresponding restriction or opening downhole to form a corresponding fluid barrier. For the example implementation of FIG. 3, the untethered object 300 includes an agent 308 that is disposed on the exterior of the solid component 304. In accordance with example implementations, the agent 308 is bonded or otherwise affixed to the exterior surface of the solid component 304. As examples, the agent 308 may be formed on the solid component 304 by overmolding, hot hydrostatic pressing (HIPing), dipping of the solid component 304 into a bath, or spraying of the agent 308 onto the solid component 304.

In accordance with example implementations, the agent 308 may be constructed to be released from the solid component 304 after the untethered object 300 lands in the downhole restriction for purposes of filling any gaps in the downhole fluid barrier. For example, the agent 308 may include particles or a coagulant agent, which has the ability to consolidate gaps. For example, the agent 308 may contain particles (sand particles, for example) and/or fibers to fill any gaps in the downhole fluid barrier. Moreover, in accordance with example implementations, for purposes of retaining the particles/fibers on the untethered object 300 as the object is traveling downhole, the particles/fibers may be held together by a corresponding binding agent (glue, resin or cement, as examples), which dissolves in the presence of one or more downhole fluids to release the particles/fibers. In this manner, the binding agent may be water and/or oil soluble.

In accordance with further example implementations, the agent 308 may be a gelifier or coagulating agent that thickens in the presence of one or more downhole fluids. In this manner, the thickened gel is released from the solid component 304 to close any gaps in the fluid barrier.

In further example implementations, the agent 308 may be a coating that is retained on the solid component 304 and constructed to deform to seal any gaps. As examples, the agent 308 may be a foam or an elastomer layer. Moreover, in accordance with some implementations, a strengthening agent, such as a polymer fiber or polymer particles may be present in such a foam or elastomer layer for purposes of strengthening the agent 308 and further improving its gap sealing ability.

As also depicted in FIG. 3, in accordance with example implementations, the untethered object 300 may contain a protective outer layer 310, which covers, or surrounds, the agent 308. In this manner, in accordance with some implementations, the outer layer 310 may be a protective film or coating (a polytetrafluoroethylene (PTFE) layer, for example) that protects the agent 308 and/or prevents the release of the agent 308 until the untethered object 300 lands on the downhole restriction and is at the appropriate position for agent delivery, as further described herein. In this manner, the outer layer 310 may be crushed or broken apart by the downhole restriction and/or may dissolve/degrade slower than the agent 308 to effect a time release of the agent 308.

In accordance with further example implementations, the outer layer 310 may also be an agent that performs a specific downhole function. As examples, the outer layer 310 may be sealing agent that is constructed to seal any gaps in a downhole fluid barrier. The outer layer 310 may, however, perform a downhole function other than sealing, such as altering a pH of a downhole environment to controllably degrade a downhole component, plugging pores, or serving as an agent to deliver a protective coating for certain downhole component(s).

Figure 4A:
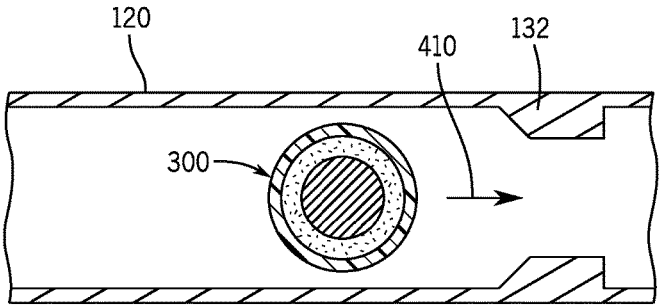
FIG. 4A is a schematic diagram illustrating deployment of an untethered object in a well according to an example implementation.
Figure 4B:
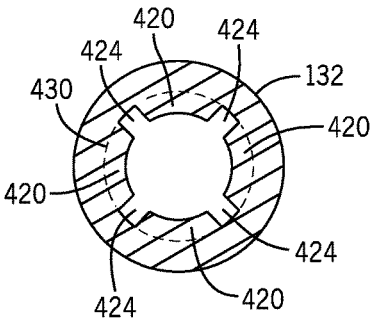
FIGS. 4B, 4C and 4D are cross-sectional views of object catching seats according to example implementations.

Referring to FIG. 4A, as a more specific example of how the untethered object 300 may be deployed and used, the untethered object 300 may be pumped in a direction 410 toward the seat 132 for purposes of landing the untethered object 300 in the seat 132. In accordance with example implementations, the seat 132 may have designed annular gaps. For example, referring to FIG. 4B in conjunction with FIG. 4A, in accordance with example implementations, the seat 132 receives the untethered object 300 in an object receiving region, generally denoted by a dashed line circle 430 of FIG. 4B. As depicted in FIG. 4B, the seat 132 has radial protrusions 420 that extend into the seat receiving region 430 and annular gaps 424 in which no material is present in the seat receiving region 430. Thus, when the untethered object 300 lands in the seat receiving region 430, a fluid barrier is formed. However, the fluid barrier does not form a complete fluid seal, due at least in part to annular gaps 424 of the seat 132.

Figure 4C:
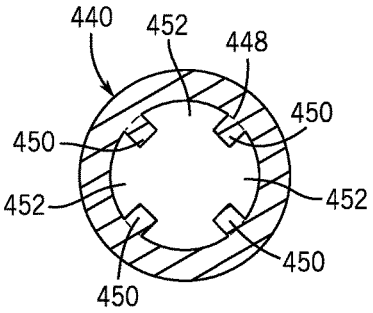

As another example, a seat 440 that is depicted in FIG. 4C may be used to receive the untethered object 300 to form a fluid barrier. The seat 440 has an object receiving region (generally depicted by dashed circle 448) and annular protrusions 450 that extend into the object receiving region 448 as well as annular recesses 452 in the seat receiving region 448. Comparing the restriction 440 with the seat 132 of FIG. 4B, the annular gaps 452 of the seat 440 of FIG. 4C occupy relatively more area than the annular gaps 424 of the seat 132 of FIG. 4B. As such, the corresponding fluid barrier that is created by the seat 440 has relatively larger gaps.

Figure 4D:
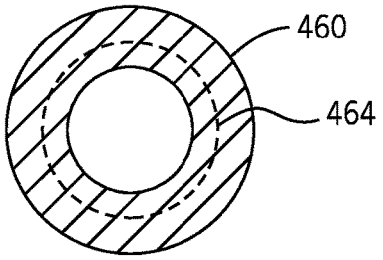

FIG. 4D depicts a seat 460 in accordance with further example implementations. Unlike the seats 132 (FIG. 4B) and 440 (FIG. 4C), the seat 460 has a continuous seat. In this manner, the material of the seat 460 continuously extends into an object receiving region 464 of the seat 460. However, even with this arrangement, small gaps may exist between the seated untethered object 300 and the seat 460, due to, for example, imperfections in the contacting surfaces or the presence of debris.

Figure 5A:
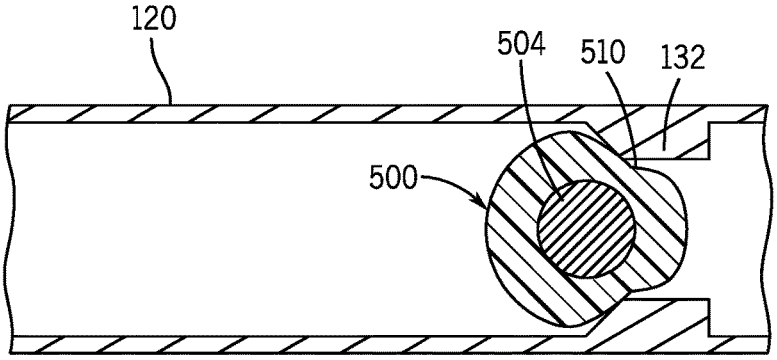
FIG. 5A is a schematic diagram illustrating landing of an untethered object of FIG. 4A in a restriction according to an example implementation.
Figure 5B:
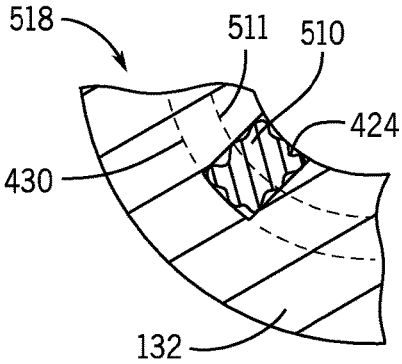
FIG. 5B is a schematic view illustrating use of a deformable agent of the untethered object of FIG. 5A to seal gaps of a restriction according to an example implementation.

Referring back to FIG. 3, in accordance with example implementations, the agent of the untethered object may be a deformable layer, which deforms when the object lands on the seat 132, as depicted in FIG. 5A. In this manner, as depicted in FIG. 5A, an untethered object 500 includes a solid inner ball 504 and an outer deformable layer 510. For this example implementation, the untethered object 500 does not have an outer layer but may have such an outer layer, in accordance with further example implementations. The layer 510 deforms when the untethered object 500 lands in the seat 132 and fluid pressure (due to the column of fluid above the untethered object 300) exerts force to press the object 500 against the seat 132 at a contacting ring 511 (see FIG. 5B) of the seat 132. Referring to FIG. 5B, the deformation of the layer 506, in turn, presses the layer 510 into the gaps 424, as illustrated for an example section 518 of the seat 132.

In accordance with further example implementations, a sphere-shaped untethered object 600 that has an inner solid component 604, middle agent containing layer 608 and outer protective coating layer 610 may be used. When the untethered object 600 lands in the seat 132, a contacting seat ring 614 contacts the outer protective coating layer 610. The protective coating 610 may dissolve in time due to interaction with well fluid or may be crushed due to mechanical action. For example, the protective coating 610 may experience a shock upon landing in the seat 132, or the resulting pressure from the fluid barrier that is formed due to the untethered object 600 landing in the seat 132 may serve to otherwise remove the protective coating 610. Regardless of the particular mechanism, the removal of the protective coating 610 exposes the agent layer 608, which, for this example, is constructed to be released for purposes of sealing gaps in the fluid barrier.

Figure 6A:
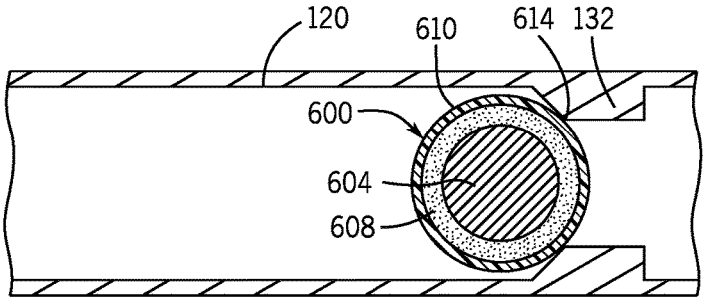
FIG. 6A is a schematic view illustrating landing of an untethered object in a restriction according to a further example implementation.
Figure 6B:
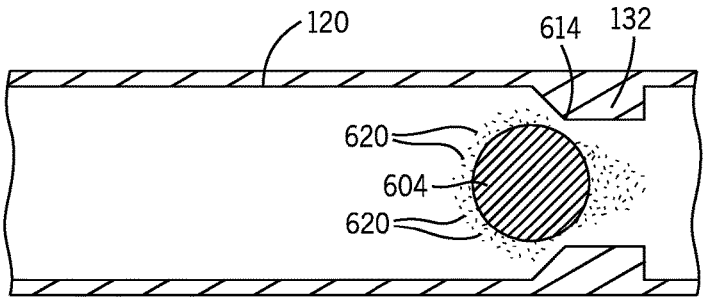
FIG. 6B is an illustration depicting diffusion of an agent carried into the well by the untethered object of FIG. 6A according to an example implementation.
Figure 6C:
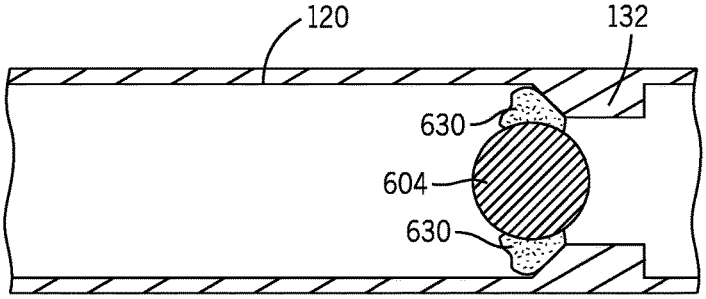
FIGS. 6C and 6D are schematic views illustrating the use of the agent to fill gaps according to further example implementations.
Figure 6D:
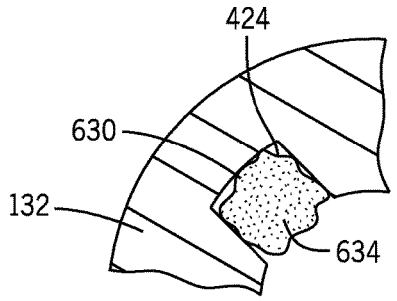

More specifically, referring to FIG. 6B, in accordance with example implementations, the agent layer 608 disperses, as depicted by agent particles 620 in FIG. 6B. The dispersed agent particles 620, in turn, are directed by the flow through the gaps in the fluid barrier. For example, near the contacting ring 614, flow paths may exist between the solid component 604 and the seat contacting ring 614 due to, for example, surface imperfections and debris. These flow paths, in turn, disperse the agent particles 620 and carry the agent particles 620 into the gaps. Eventually, the agent particles 620 fill up or seal the gaps, thereby leaving resulting plugs 630, as depicted in FIG. 6C. Plugs 630 may also be formed in gaps 424 of a segmented seat ring (such as the segmented seat ring 132 of FIG. 4B, for example), as depicted in FIG. 6D.

Figure 7A:
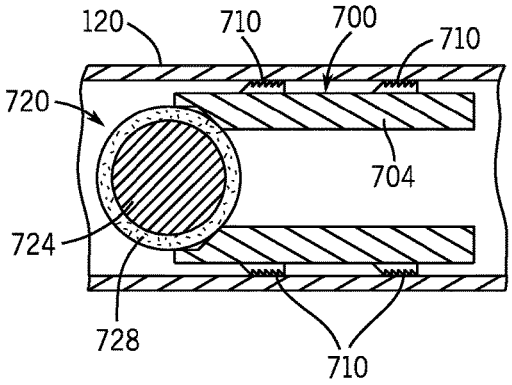
FIG. 7A is a longitudinal cross-sectional view illustrating landing of an untethered object in a seat assembly according to an example implementation.

In accordance with further example implementations, the gaps that are sealed by the sealing agent may be in places other than in a region that directly borders the sealing region. In this manner, in accordance with example implementations, the agent may not be in direct contact with the gaps to be filled. Such an arrangement is depicted in FIG. 7A. In this regard, FIG. 7A depicts a plug or seat assembly 700, which contains an inner plug or seat assembly 704, which is secured to the tubing string 120 via slips 710. A gap exists between the exterior of the seat 700 and the inner surface of the tubing string 720. Moreover, as shown in FIG. 7A, a sphere-shaped untethered object 720 that contains an inner solid component 724 and an outer agent layer 728 lands in a seat of the seat assembly 704.

Figure 7B:
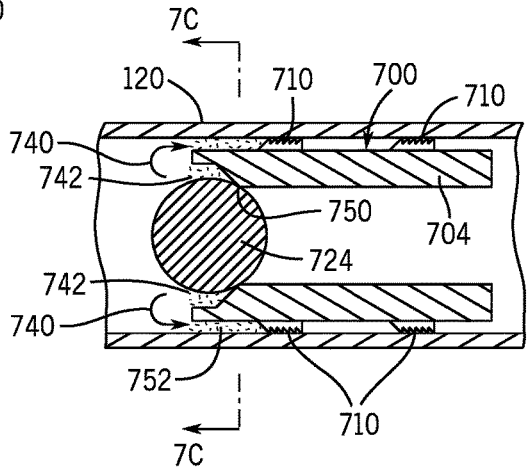
FIG. 7B is a longitudinal cross-sectional view illustrating use of the agent to fill gaps in the seat assembly according to an example implementation.
Figure 7C:
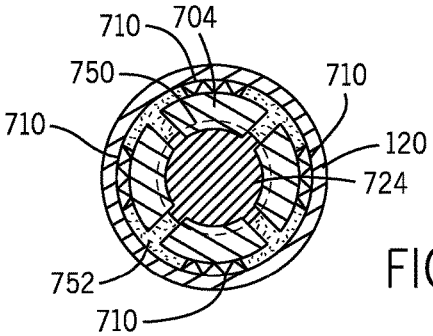
FIG. 7C is a transverse cross-sectional view taken along line 7C-7C of FIG. 7B illustrating use of the agent to fill gaps in the seat assembly according to an example implementation.

As shown in FIG. 7A, the untethered object 720 for this example implementation does not contain an outer protective coating layer, and the untethered object 720 is not in direct contact with the annular gaps between the seat assembly 704 and the tubing string 120. Referring to FIG. 7B, the gaps between the seat assembly 704 and the tubing string 120 create flow paths 740 that carry agent particles 742 into the gaps. Thus, as depicted also in FIG. 7C, the diffusion of the particles into the gaps form corresponding seals in the annular space between the seat assembly 704 and the string, as depicted at reference numeral 744 and also between gaps 742 in direct contact with the untethered object 300. Similar to the example implementation depicted in FIGS. 6A, 6B and 6C, the agent particles may also be carried by flow paths into any gaps between the solid component 724 and seat 750.

Figure 8A:
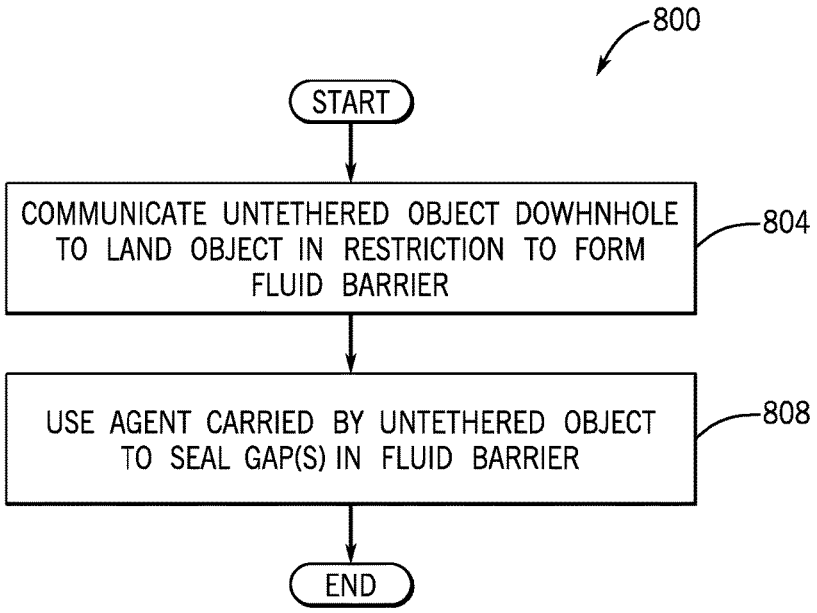
FIGS. 8A, 8B and 8C are flow diagrams depicting techniques to use an untethered object to form seals in a well according to example implementations.

Thus, referring to FIG. 8A, in accordance with example implementations, a technique 800 includes communicating an untethered object downhole in a well to land the object in a restriction to form a fluid barrier, pursuant to block 804. The technique 800 includes using an agent that is carried by the untethered object to seal one or more gaps in the fluid barrier, pursuant to block 808.

Figure 8B:
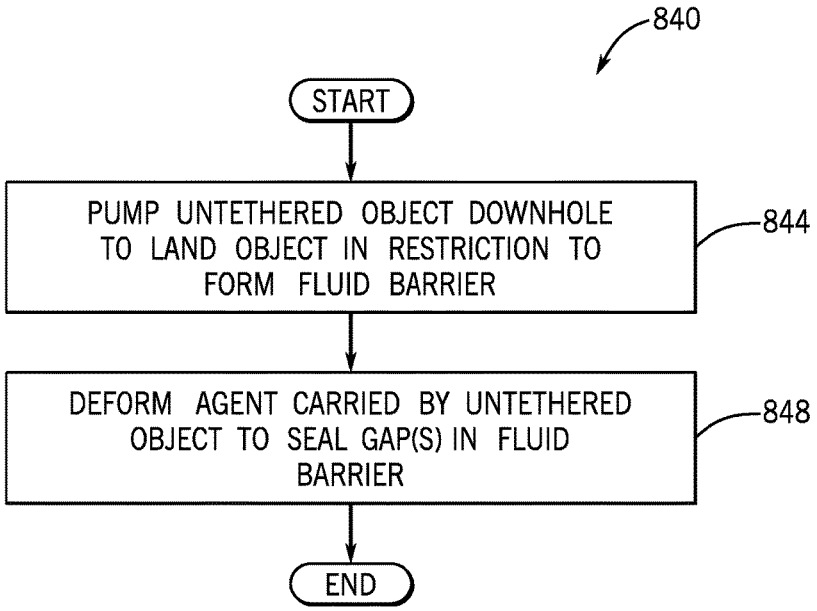

Referring to FIG. 8B, in accordance with example implementations, a technique 840 pumping (block 844) an untethered object downhole in a well to land the object in a restriction to form a fluid barrier. The technique 840 includes deforming (block 848) an agent carried by the untethered object to seal one or more gaps in the fluid barrier.

Figure 8C:
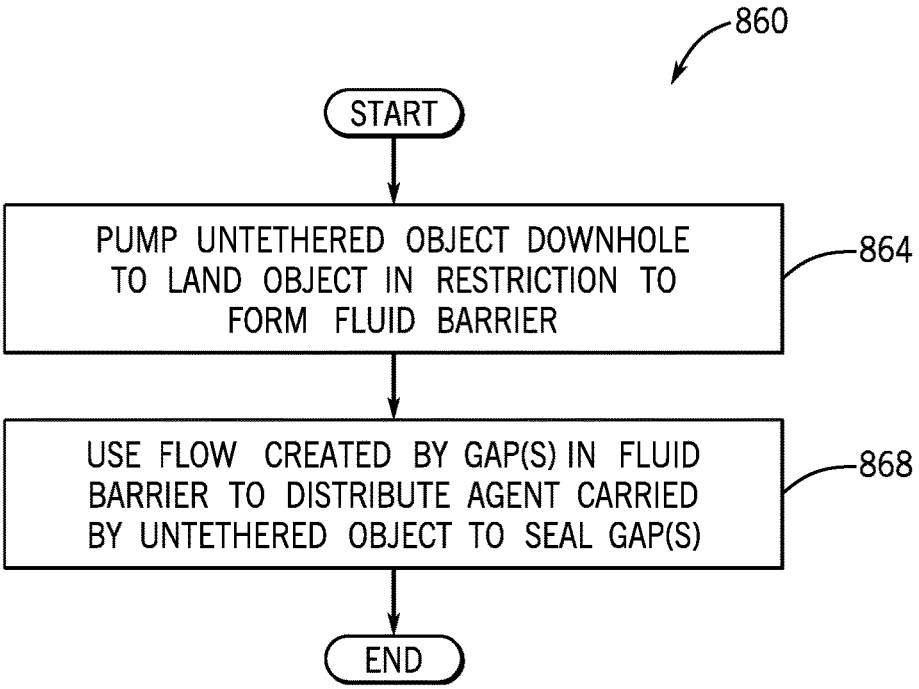

Referring to FIG. 8C, in accordance with example implementations, a technique 860 includes pumping an untethered object downhole in a well to land the object in a restriction of the well to form a fluid barrier, pursuant to block 864. The technique 860 includes using a flow created by one or more gaps in the fluid barrier to distribute an agent that is carried by the untethered object into the gap(s) to seal the gap(s), pursuant to block 868.

Other implementations are contemplated, which are within the scope of the appended claims. For example, in accordance with further example implementations, the inner solid component of the untethered object may be constructed from a degradable/oxidizable material that degrades/oxidizes over time to remove the fluid barrier. In a similar manner, one or more components of the downhole restriction may be formed from such a degradable/oxidizable material. As a more specific example, in accordance with example implementations, the degradable/oxidizable material may be constructed to retain its structural integrity for downhole operations that rely on the fluid barrier (fluid diversion operations, tool operations, and so forth) for a relatively short period of time (a time period for one or several days, for example). However, over a longer period of time (a week or a month, as examples), the degradable/oxidizable material(s) may sufficiently degrade in the presence of wellbore fluids (or other fluids that are introduced into the well) to cause a partial or total collapse of the material(s). In accordance with example implementations, dissolvable or degradable may be similar to one or more of the alloys that are disclosed in the following patents: U.S. Pat. No. 7,775,279, entitled, "Debris-Free Perforating Apparatus and Technique," which issued on Aug. 17, 2010; and U.S. Pat. No. 8,211,247, entitled, "Degradable Compositions, Apparatus Compositions Comprising Same, And Method of Use," which issued on Jul. 3, 2012.

While a limited number of examples have been disclosed herein, those skilled in the art, having the benefit of this disclosure, will appreciate numerous modifications and variations therefrom. It is intended that the appended claims cover all such modifications and variations.

What is claimed is:

1. A method usable with a well, comprising:

communicating an untethered object downhole in the well to land the object in a restriction within a longitudinal flowpath of the well to form a fluid barrier within the longitudinal flowpath, wherein the untethered object comprises: an outer agent layer; and an inner solid component; and using an agent carried by the outer agent layer of the untethered object to seal at least one gap in the fluid barrier in the longitudinal flowpath, the agent not being in direct contact with the at least one gap, wherein using the agent carried by the outer agent layer of the untethered object to seal the at least one gap comprises using a flow created by the at least one gap to distribute the agent.

2. The method of claim 1, wherein using the agent to seal that at least one gap comprises deforming the agent.

3. The method of claim 2, wherein deforming the agent comprises deforming an outer coating of the untethered object in response to the untethered object landing in the restriction such that the deformed coating fills at least one gap between an undeformed footprint of the untethered object and a seat of the restriction.

4. The method of claim 2, wherein deforming the agent comprises deforming an elastomer or a foam.

5. The method of claim 2, wherein deforming the agent comprises deforming an agent comprising fibers or particles held together by a binding agent.

6. The method of claim 1, wherein using the agent further comprises removing an outer protective coating of the untethered object.

7. The method of claim 1, wherein using the agent further comprises removing an agent attached to a solid object of the untethered object through hot hydrostatic pressing (HIPing), overmolding, dipping or spraying.

8. The method of claim 1, wherein using the agent comprises using a coagulating agent.

9. An apparatus usable with a well, comprising:

a solid component to be deployed and be communicated downhole as an untethered object to land in a restriction in a longitudinal flowpath in the well to form a fluid barrier; and an agent layer attached to an outside of the solid component to seal at least one gap in the fluid barrier in the longitudinal flowpath, the agent layer not being in direct contact with the at least one gap, wherein the agent layer attached to the outside of the solid component is adapted to be released from the solid component in response to the solid component landing in the restriction and use a flow created by the at least one gap to seal the at least one gap.

10. The apparatus of claim 9, wherein the agent layer is adapted to deform to seal the at least one gap.

11. The apparatus of claim 9, wherein the solid component comprises a ball, a dart or a bar.

12. The apparatus of claim 9, further comprising a protective layer to cover the agent layer such that the agent layer is protected by the protective layer while the untethered object is communicated downhole.

13. The apparatus of claim 12, wherein the protective layer is adapted to be removed to release the agent layer.

14. An apparatus usable with a well, comprising:

a string comprising a passageway and having a restriction in the passageway; and an untethered object to be deployed in the passageway, the untethered object comprising:

a solid component to be deployed and be communicated downhole as an untethered object to land in a restriction in the string within the well to form a fluid barrier in a longitudinal flowpath of the well; and an outer agent layer attached to the solid component to seal at least one gap in the fluid barrier, the outer agent layer not being in direct contact with the at least one gap, wherein the outer agent layer is adapted to be released from the solid component in response to the solid component landing in the restriction and use a flow created by the at least one gap to seal the at least one gap.

15. The apparatus of claim 14, wherein the restriction comprises a plug assembly, a valve assembly or a seat assembly.

16. The apparatus of claim 14, wherein:

the restriction comprises a seat on which the untethered object lands; and the gap comprises a gap in a region other than a region between the seat and the untethered object when the untethered object lands in the restriction.

17. The apparatus of claim 14, wherein the solid component comprises a degradable material.

18. The apparatus of claim 14, wherein the restriction comprises a degradable material.

* * * * *